US006205973B1

(12) United States Patent
Bauer et al.

(10) Patent No.: US 6,205,973 B1
(45) Date of Patent: Mar. 27, 2001

(54) METHOD AND ARRANGEMENT FOR DETERMINING THE TORQUE OF AN INTERNAL COMBUSTION ENGINE HAVING DIRECT GASOLINE INJECTION

(75) Inventors: Hartmut Bauer, Gerlingen; Dieter Volz, Heilbronn; Jürgen Gerhardt, Oberriexingen; Jürgen Pantring, Schwieberdingen; Michael Oder, Illingen; Werner Hess, Stuttgart; Christian Köhler, Erligheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/422,065

(22) Filed: Oct. 1, 1999

(30) Foreign Application Priority Data

Nov. 3, 1998 (DE) ..... 198 50 581

(51) Int. Cl.[7] ..... F02D 41/14

(52) U.S. Cl. ..... 123/294; 123/295; 123/350; 701/102

(58) Field of Search ..... 123/294, 295, 123/305, 350, 352, 361, 436, 480; 73/116, 117.3; 701/102, 103, 104

(56) References Cited

U.S. PATENT DOCUMENTS

| | | | | |
|---|---|---|---|---|
| 5,692,471 | | 12/1997 | Zhang | 123/350 |
| 5,692,472 | * | 12/1997 | Bederna et al. | 123/350 |
| 5,755,198 | * | 5/1998 | Grob et al. | 123/295 |
| 6,092,507 | * | 7/2000 | Bauer et al. | 123/430 |
| 6,116,210 | * | 9/2000 | Oder et al. | 123/305 |

* cited by examiner

*Primary Examiner*—Tony M. Argenbright
(74) *Attorney, Agent, or Firm*—Walter Ottesen

(57) ABSTRACT

The invention is directed to a method for determining the actual torque of an internal combustion engine having gasoline direct injection. In the method, the torque of the engine is computed with a model in dependence upon operating variables. A value for the maximum torque, which would be achieved under standard conditions, is specified from a pregiven characteristic field in dependence upon operating variables which characterize an operating point of the engine. An efficiency is inputted for at least one torque-influencing actuating variable of the engine with the efficiency being formed in dependence upon a current or present value of the actuating variable and a standard value of the actuating variable. The maximum torque is corrected with the efficiency to determine the actual torque. The invention is also directed to an arrangement for determining the actual torque of the engine.

7 Claims, 2 Drawing Sheets

METHOD AND ARRANGEMENT FOR DETERMINING THE TORQUE OF AN INTERNAL COMBUSTION ENGINE HAVING DIRECT GASOLINE INJECTION

BACKGROUND OF THE INVENTION

U.S. Pat. No. 6,092,597 discloses a control system for an internal combustion engine having gasoline direct injection. In this control system, the fuel mass, which is to be injected, is determined from a desired value for the torque of the engine. A procedure is also presented with which this engine can be switched over between the different modes of operation. The most essential modes of operation of such an engine are an operation of the engine with charge stratification in an almost unthrottled operation as well as a throttled operation of the engine with homogeneous injection. For an engine having gasoline direct injection, it is important to determine the actual torque of the engine. This value is, for example, outputted to other control units (for example, a drive slip control) for further evaluation or is evaluated within the control system, for example, for initializing filters and, if required, for monitoring, et cetera.

U.S. patent application Ser. No. 254,582, filed Jul. 1, 1998 (German patent publication 197 29 100) discloses a model for determining the torque of an internal combustion engine having gasoline direct injection. In this model, the actual combusted fuel mass is determined on the basis of the inducted air mass, the returned exhaust-gas mass, the oxygen concentration of the exhaust gas and a conversion factor. The actual torque of the engine is derived from this computed combusted fuel mass. It has been shown that the application of this model leads, in some cases, to unsatisfactory results because additional quantities, which operate on the torque, are not considered. Furthermore, this model is not consistent. This means that the actual torque can be determined but the inversion of the model (that is, the computation of the actuating quantities of the engine in dependence upon the desired torque) is not ensured. For this reason, various models are used to determine the actual torque and to convert the desired torque so that the complexity with respect to the control of the engine is increased.

U.S. Pat. No. 5,692,471 discloses a consistent torque model with reference to an internal combustion engine having intake manifold injection. There, the torque of the engine is computed from an optimal torque, which defines the maximum torque of the engine under standard conditions, as well as from degrees of efficiency with respect to the mixture composition, the ignition angle adjustment, and the suppression of fuel injections. The optimal torque is determined in dependence upon engine rpm and engine load (charge). With the efficiencies, the influences of the deviations of the actual values from the standard conditions, which form the basis of the formation of the optimal torque, are considered. With a corresponding inversion of the model, not only the actual torque of the engine can be determined from the actuating quantities, but also the actuating quantities can be determined in dependence upon a desired torque value. This model is not limited to an engine having gasoline direct injection because additional or changing requirements are to be considered as a consequence of the different modes of operation.

SUMMARY OF THE INVENTION

It is an object of the invention to provide measures for determining the actual torque of the internal combustion engine having gasoline direct injection.

The method of the invention is for determining the actual torque of an internal combustion engine having gasoline direct injection. The method includes: computing the torque of the engine with a model in dependence upon operating variables; specifying a value for the maximum torque, which would be achieved under standard conditions, from a pre-given characteristic field in dependence upon operating variables which characterize an operating point of the engine; inputting an efficiency for at least one torque-influencing actuating variable of the engine with the efficiency being formed in dependence upon a current or present value of the actuating variable and a standard value of the actuating variable; and, correcting the maximum torque with the efficiency to determine the actual torque.

A model for determining the torque of the engine is determined for the almost unthrottled operation of an engine with direct injection. With this model, the individual influences on the engine torque are separated. In this way, it is possible to consider all influence quantities on the torque of the engine in a simple manner. The computation steps, which are necessary for computing the torque, are reduced. Furthermore, it is advantageous that cross-couplings of the actuating quantities, for example, throttle flap position, ignition time point, injection time, et cetera, are eliminated when these actuating quantities influence the engine torque. In addition, the particular equipment of the engine can be considered for the computation of a model in a simple manner. The particular equipment of the engine, for example, can be with or without a swirl flap, cam shaft adjustment, et cetera.

It is especially advantageous that the model is consistent, that is, that the computation of the actual torque can be carried out from measured values of the torque-influencing parameters as well as that the computation of actuating quantities for these parameters can be carried out for a required torque with a unitary model.

It is especially advantageous that the torque model, which has been shown suitable for the determination of the actual torque of an engine having gasoline direct injection for the almost unthrottled operation of the engine, has the corresponding structure as the torque model for the computation of the actual torque for an engine having intake manifold injection and homogeneous fuel mixture formation. In this way, a single torque model can be used for determining the actual torque or for determining the actuating variables for an engine having gasoline direct injection in all modes of operation independently of whether throttled or not. Only individual model parameters are to be switched over between unthrottled and throttled operation of the engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
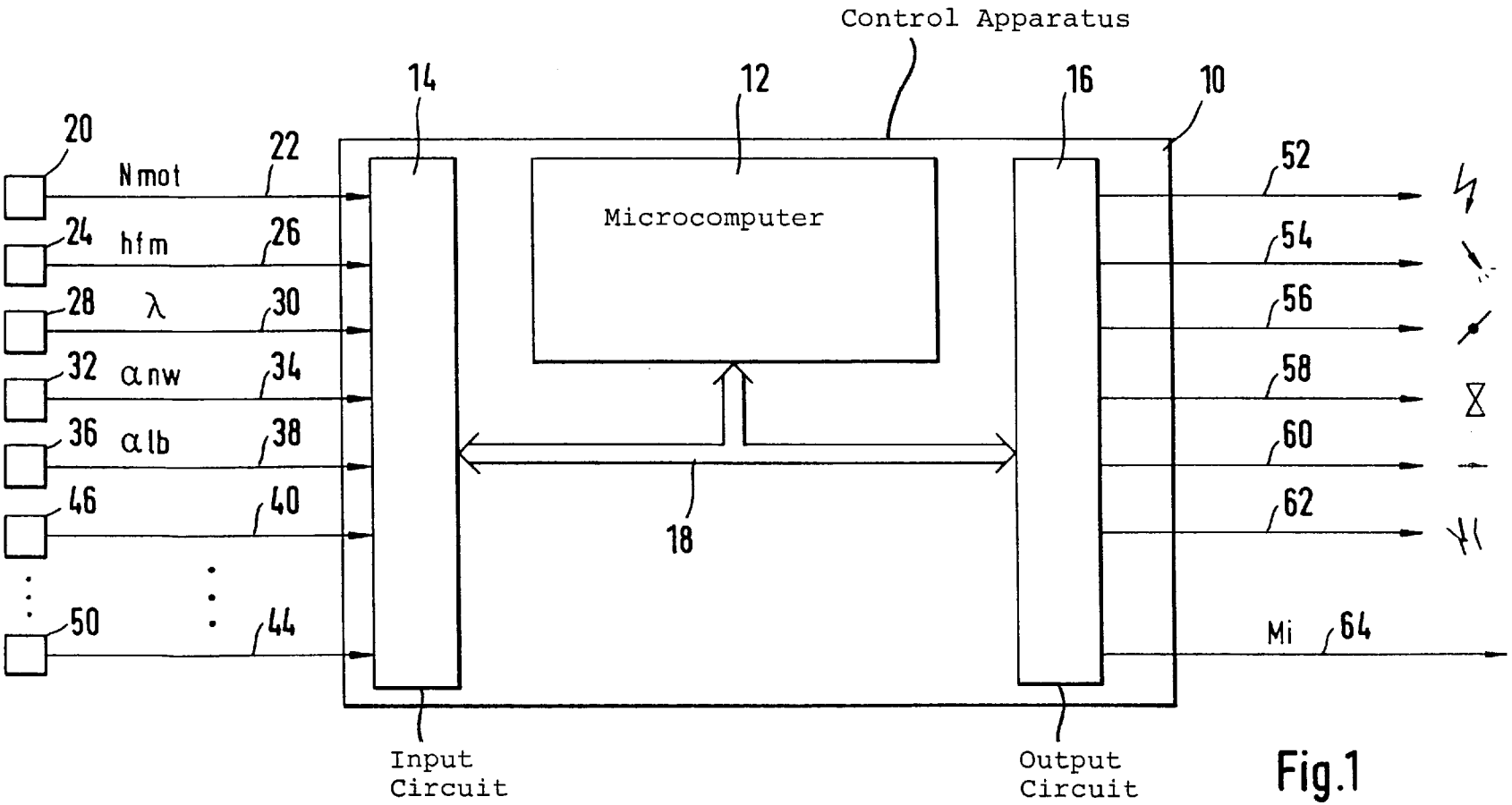
FIG. 1 is a schematic block diagram of a control arrangement for controlling an internal combustion engine having gasoline direct injection; and, FIG. 2 is a preferred embodiment of a model for determining the torque of an engine having gasoline direct injection for the unthrottled operation in the context of a sequence diagram.

FIG. 1 shows a control apparatus 10 for an internal combustion engine having gasoline direct injection. The control apparatus 10 includes at least a microcomputer 12, an input circuit 14, an output circuit 16, and a communication system for interconnecting these components. Signals are supplied to the input circuit 14 via input lines which, in a preferred embodiment, are united in a bus system and are shown separately in FIG. 1 for the sake of clarity. The operating quantities, which are used for controlling the engine, are derived from these signals.

The operating variables are explicitly shown which are needed with respect to the torque model and the actual torque computation in the preferred embodiment. These operating variables are: a signal, which represents the engine rpm NMOT, and is supplied from a corresponding measuring device 20 and an input line 22 of the input circuit 14; a quantity HFM supplied from a measuring device 24 via line 26 and defining the air mass supplied to the engine; a signal, which represents the exhaust-gas composition λ, and supplied by at least one measuring device 28 via the line 30 to the input circuit 14; in a preferred embodiment, and with systems having camshaft adjustment (that is, with a control of the input/output valves of each cylinder), a signal transmitted from a measuring device 32 via the line 34 to the control apparatus 10 with this signal representing the position of the camshaft αnw; and, with the use of a flap which narrows the cross section (that is, a swirl flap in the induction system), a signal is supplied from a measuring device 36 via the line 38, with this signal representing the position αlb of this flap.

Additional input lines 42 to 44 are shown in FIG. 1 which supply operating quantities to the control apparatus 10 from corresponding measuring devices 46 to 50 and include, for example, the position of a throttle flap, engine temperature, et cetera. These operating variables are necessary for controlling the engine. The control apparatus 10 outputs the actuating quantities for controlling the engine via the output circuit and outputs further operating quantities to other control units. This is shown in FIG. 1 by the output lines.

In the preferred embodiment, the control apparatus 10 influences the ignition angle in the cylinders of the engine (output line 52); the fuel mass, which is to be injected, and the injection time point thereof (output line 54); the position of an electrically actuable throttle flap for adjusting the air supply (output line 56); an exhaust-gas recirculation valve which controls the rate of the exhaust gas quantity recirculated from the exhaust-gas system into the intake system (output line 58); a swirl flap (output line 60) which adjusts the swirl of the inducted operating means; and, the control times of the input and output valves of the cylinders of the engine (output line 62), which are adjusted, in the preferred embodiment, via corresponding control of the camshaft position of the engine. Furthermore, the actual torque mi of the engine is outputted via the output line 64 (as a rule, via a bus system) to other control units such as drive slip control, a transmission control unit, et cetera.

In addition to supplying operating variables, the other operating variables (for example, the exhaust-gas recirculation rate, the injection time point), which are evaluated for determining the actual torque, are determined internally from actuating quantities or from the measured quantities. This applies also as an alternate possibility for determining the operating quantities shown in FIG. 1 as measured. For example, the position of the swirl flap and the camshaft position can be derived from the corresponding control signals.

In the microcomputer 12, programs are implemented which form actuating quantities from the supplied operating parameters and these actuating quantities are for controlling the engine in correspondence to inputs by the driver and, if required, other control systems. A desired torque is determined which is converted into drive signals for controlling the power influencing quantities while considering the actual situation of the engine. Here, the engine is operated in different operating modes in dependence upon the load region; for example, the engine is operated in the lower load range almost unthrottled with a stratified mixture distribution and, in the upper load range, throttled with homogeneous mixture formation comparable to an engine with intake manifold injection. The knowledge of the actual torque of the engine is of special significance for the internal computation operations and/or for the output to other control units.

The indicated high pressure torque of the engine is determined while utilizing the model described below for all modes of operation of the engine. This indicated high-pressure torque is converted into other torques of the engine, for example, by considering the charge/discharge exchange losses (the rush flow between inlet and outlet valves of a cylinder) and the torque requirement of the driven consumers in the effective torque of the engine.

Figure 2:
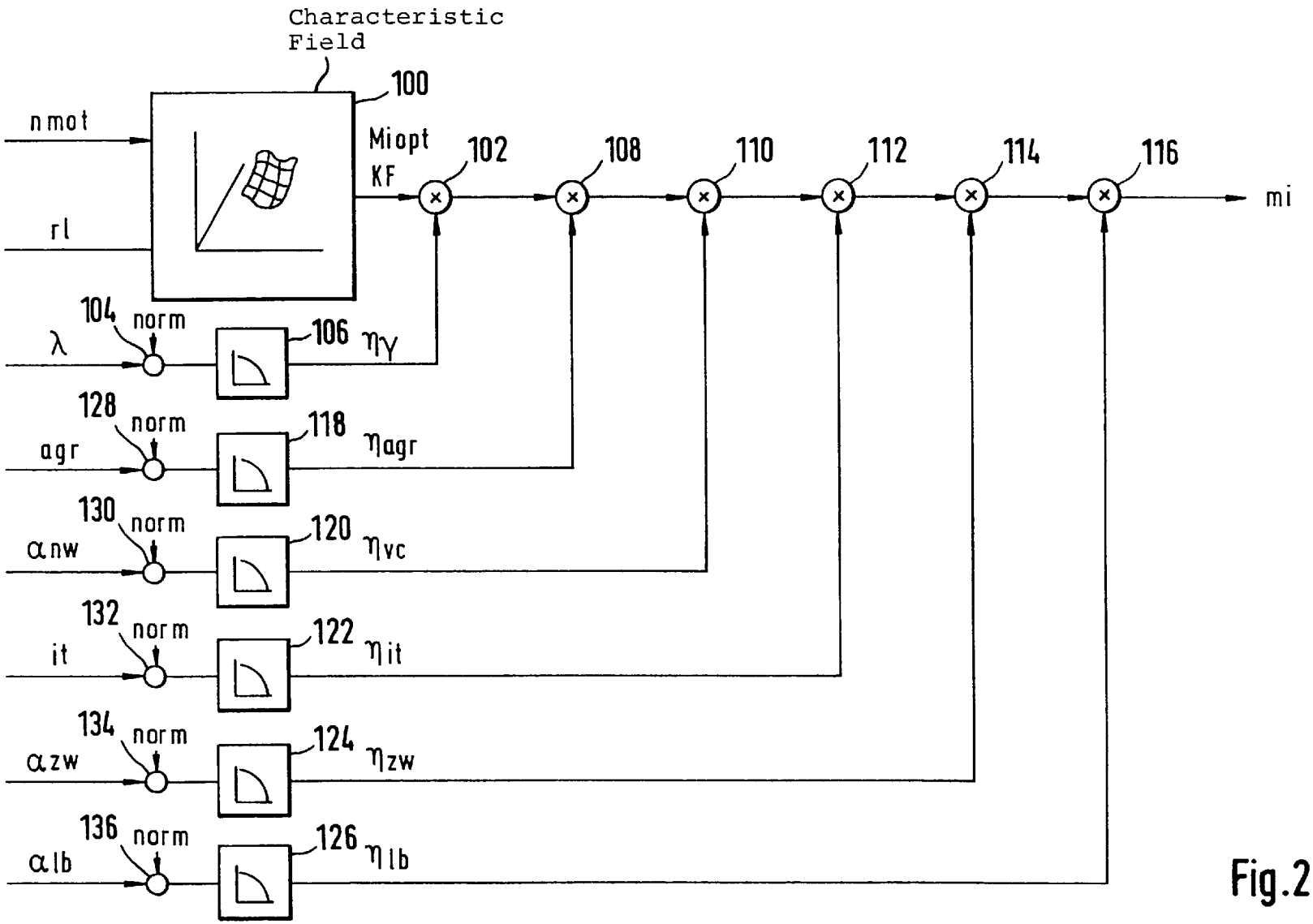

In the unthrottled operation of the engine, the torque model, which is shown in FIG. 2, is utilized and, on the basis thereof, a computation of the actual torque as well as a conversion of the desired torque into actuating quantities takes place.

In the torque model shown in FIG. 2, standard values for the torque-influencing actuating quantities are defined for determining the actual torque of a direct-injection gasoline internal combustion engine. Furthermore, a characteristic field is provided which contains the maximum indicated high pressure torque for the operating points of the engine under standard conditions. An operating point is fixed by the engine rpm and the engine load (for example, relative air charge) which are determined from the measured air mass signal. Furthermore, for each torque-influencing actuating quantity, an efficiency is defined which shows the effect of the deviation of the actuating quantity from its defined standard actuating quantity on the torque.

If an internal combustion engine having gasoline direct injection is driven in an almost unthrottled operation, the following actuating quantities influence the torque: the air/fuel ratio λ, the exhaust-gas recirculation rate egr, the injection time point it, the ignition angle αzw as well as the camshaft position αnw (depending upon the equipment for the control possibility of the camshaft available and therefore the inlet and outlet valves), and/or, if a swirl flap is present, the position αlb of this swirl flap.

The standard quantities comprise either a fixedly pregiven number (for example, λ=1) or are likewise dependent upon the operating point (engine rpm and load) as is the case for an ignition angle whose standard quantity defines an ignition angle which leads to a maximum torque (optimal ignition angle) at the particular operating point.

If the engine does not have a swirl flap and no possibility for adjusting the camshaft, this efficiency is not considered.

The model is defined by the following determination equation:

$$mi=KF*eta(pos1)*eta(pos2)*\ldots*eta(posn)$$

wherein:

mi is the indicated high pressure torque;

KF is the maximum torque under standard conditions;

eta is the efficiency; and, pos1 . . . n are the actuating quantities to be considered.

In the example of the preferred embodiment, the following results:

$$mi=miopt(rl,nmot,norm)*eta\lambda*etaegr*etait*eta\alpha nw*eta\alpha zw*eta\alpha lb$$

wherein:

miopt is the maximum torque rl is the relative air charge nmot is the engine rpm norm the standard values for the individual actuating quantities etaλ is the efficiency of the air/fuel mixture etaegr is the efficiency of the exhaust-gas recirculation rate etait is the efficiency of the injection time point etaαnw is the efficiency of the camshaft position etaαzw is the efficiency of the ignition angle etaαlb is the efficiency of the position of the swirl flap.

The computation of this model is shown with respect to the sequence diagram of FIG. 2. The characteristic field 100 for the maximum indicated high pressure torque inputs the maximum indicated high pressure torque miopt in dependence upon the engine rpm nmot and the relative air charge rl. The relative air charge is formed from the measured supplied air mass while considering the intake manifold dynamic. In a first logic element 102, this maximum indicated high pressure torque value is corrected with the actual efficiency of the actual adjusted air/fuel mixture. For this purpose, the deviation of the actual oxygen concentration from a standard value is formed in the comparison element 104 and, by means of a characteristic line 106, the efficiency etaλ is determined with which the maximum indicated high pressure torque is corrected, preferably via multiplication.

The maximum value, which is corrected in this manner, is corrected in the corrective position (108, 110, 112, 114, 116) with the corresponding efficiencies of the actual exhaust-gas recirculation rate, the actual camshaft position, the actual injection time point, the actual ignition angle position, and the actual position of the swirl flap and, in this way, the actual torque value mi is formed.

For the determination of the individual efficiencies, characteristic lines (118, 120, 122, 124, 126) are provided wherein the efficiency is stored in dependence upon the deviation of the actually adjusted value from the particular standard value. These deviations are formed in the comparator positions (128, 130, 132, 134, 136) of the particular quantity. The efficiencies represent the relative effects of these deviations on the torque of the engine. When the actuating quantity has its standard value (deviation zero), the efficiency is 1.

This model is also utilized to compute the individual actuating quantities from a pregiven desired torque value Mides. This takes place via a corresponding transformation of the above-mentioned equation with the desired torque value being utilized in lieu of the actual torque value. In this way, a desired efficiency (etades(pos1)) for a specific actuating quantity is determined from which the actuating quantity itself is computed while considering the pregiven standard value. This is carried out successively for all actuating quantities in accordance with a pregiven sequence while considering the actual position quantities or efficiencies:

$$etades(pos1)=Mides/(KF*eta(pos2)* \ldots *eta(posn)).$$

The torque model computes the indicated high pressure torque. The losses from the charge/discharge exchange and the drive of the ancillary equipment are subtracted to compute the effective torque of the engine. The described efficiency characteristic lines or the characteristic field for the maximum high pressure torque are determined with the aid of optimizing algorithms for each type of internal combustion engine.

The torque model described in FIG. 2 is provided for the unthrottled operation of an engine having gasoline direct injection. For a switchover to a throttled operation, it has been shown that this model no longer supplies satisfactory results because of the changed peripheral conditions. For this reason, a switchover between the models or of parts of a model for the unthrottled and for the throttled operation are provided. The efficiency characteristic lines are switched over to characteristic lines optimized for the other mode of operation. In a preferred embodiment, the characteristic field for the maximum indicated torque is retained; however, applications can occur in which even this characteristic field is switched over to a characteristic field optimized for homogeneous operation.

For the switchover from one model to the other model (or for a switchover of parts of a model), the actual torque mi is initialized with the previous value in order to avoid an abrupt transition as a consequence of computation tolerances.

A corresponding switchover at least of parts of the model takes place with the change from one mode of operation to another mode of operation. Operating modes are: operation with stratified layer operation, homogeneous operation with stoichiometric or lean mixture or mixed operating modes with double injection (homogeneous stratified).

It is understood that the foregoing description is that of the preferred embodiments of the invention and that various changes and modifications may be made thereto without departing from the spirit and scope of the invention as defined in the appended claims.

What is claimed is:

1. A method for determining the actual torque of an internal combustion engine having gasoline direct injection, the method comprising:

computing the torque of said engine with a model in dependence upon operating variables;

specifying a value for the maximum torque, which would be achieved under standard conditions, from a pregiven characteristic field in dependence upon operating variables which characterize an operating point of said engine;

inputting an efficiency for at least one torque-influencing actuating variable of said engine with said efficiency being formed in dependence upon a current or present value of said actuating variable and a standard value of said actuating variable; and, correcting said maximum torque with said efficiency to determine said actual torque.

2. The method of claim 1, wherein efficiencies are provided for at least one of the following actuating quantities: the air/fuel ratio, the exhaust-gas recirculation rate, the position of a cam shaft, the time point of the start injection, the ignition angle, and the position of the swirl flap.

3. The method of claim 1, wherein the characteristic field for said maximum torque is dependent upon engine rpm and engine load or relative charge.

4. The method of claim 1, wherein said torque is the indicated high pressure torque.

5. The method of claim 1, comprising the further step of computing the effective torque while considering the losses caused by exchange of charges in the cylinders and the losses caused by ancillary consumers.

6. The method of claim 1, wherein the mode of operation of said engine can change at least between an unthrottled mode of operation and a throttled mode of operation and vice versa; and, the method comprises the further step of switching between models which are especially adapted for these respective modes of operation or at least switching between respective parts of said models.

7. An arrangement for determining the actual torque of an internal combustion engine having gasoline direct injection, the arrangement comprising:

a model for computing the torque of said engine in dependence upon operating variables;

a characteristic field from which the maximum torque is determined under standard conditions in dependence upon operating variables which determine the operating point of said engine;

means for forming at least one quantity which defines the efficiency of at least one torque-influencing actuating variable in dependence upon the deviation of the current or present value of the standard value corresponding thereto; and, means for specifying said actual torque by correcting the maximum torque with the aid of at least one efficiency value.

* * * * *

UNITED STATES PATENT AND TRADEMARK OFFICE

CERTIFICATE OF CORRECTION

PATENT NO. : 6,205,973 B1
DATED : March 27, 2001
INVENTOR(S) : Hartmut Bauer et al.

It is certified that error appears in the above-identified patent and that said Letters Patent is hereby corrected as shown below:

Title page,
Item [22], under "Filed:", delete "Oct. 1, 1999" and substitute -- Oct. 21, 1999 -- therefor.

Signed and Sealed this

Fourth Day of February, 2003

JAMES E. ROGAN
*Director of the United States Patent and Trademark Office*